US005322211A

United States Patent [19]

Petersen

[11] Patent Number: 5,322,211

[45] Date of Patent: Jun. 21, 1994

[54] PACKAGING CARTON FOR DRY, FLOWABLE PRODUCTS

[75] Inventor: Steen M. Petersen, Hjortshoej, Denmark

[73] Assignee: Schouw Packing A/S, Lystrop, Denmark

[21] Appl. No.: 37,685

[22] Filed: Mar. 25, 1993

Related U.S. Application Data

[63] Continuation of Ser. No. 476,465, Jun. 8, 1990, abandoned.

[51] Int. Cl.[5] ..... B65D 5/74

[52] U.S. Cl. ..... 229/125.42; 229/137; 229/217

[58] Field of Search ..... 229/125.42, 137, 215, 229/216, 217, 138, 137, 139, 125.42; 206/621.3, , 621.4, 621, 631.1, 631.2

[56] References Cited

U.S. PATENT DOCUMENTS

| | | | |
|---|---|---|---|
| 1,697,664 | 1/1929 | Schweich . | |
| 2,034,594 | 3/1936 | Norris et al. | 229/125.42 |
| 2,064,029 | 12/1936 | Murray . | |
| 2,205,068 | 6/1940 | Potter | 229/125.42 |
| 2,323,505 | 7/1943 | Wilcox | 229/125.42 |
| 2,789,747 | 4/1957 | Graybill | 229/125.42 |
| 3,002,673 | 10/1961 | Asman . | |
| 3,123,275 | 3/1964 | Bunger | 206/631.2 |
| 3,185,374 | 5/1965 | Feeney | 206/631.2 |
| 3,207,413 | 9/1965 | Ficaro . | |
| 3,244,353 | 4/1966 | Miessler, Sr. | 229/139 |
| 3,306,514 | 2/1967 | MacKendrick | 206/621.1 |
| 3,669,344 | 6/1972 | Andersson et al. | 229/145 |
| 3,982,683 | 9/1976 | Forteau | 206/621.3 |
| 4,572,422 | 2/1986 | Heuberger et al. | 220/461 |
| 4,582,246 | 4/1986 | Lisiecki | 206/631.2 |
| 4,657,174 | 4/1987 | Hennig | 206/626 |
| 4,657,177 | 4/1987 | Karabedian | 229/125.42 |
| 4,732,275 | 3/1988 | Hambleton et al. | 206/621.3 |
| 4,884,695 | 12/1989 | Kjelgaard | 229/123.1 |
| 4,911,306 | 3/1990 | Lisiecki et al. | 229/137 |
| 4,997,661 | 3/1991 | Kromer et al. | 229/4.5 |
| 5,176,313 | 1/1993 | Curry et al. | 229/137 |

FOREIGN PATENT DOCUMENTS

| | | |
|---|---|---|
| 0171275 | 4/1985 | European Pat. Off. . |
| 1279533 | 10/1968 | Fed. Rep. of Germany . |
| 3402096 | 8/1985 | Fed. Rep. of Germany . |

*Primary Examiner*—Allan N. Shoap
*Assistant Examiner*—Christopher J. McDonald
*Attorney, Agent, or Firm*—Antonelli, Terry, Stout & Kraus

[57] ABSTRACT

A packaging container for dry, tricklable products, with the container being produced by folding and fixing of a flat carton member prepunched and provided with folding lines. The container includes a reclosable pouring spout at an upper end portion and is adapted to be filled from a closable bottom end thereof. The pouting spout includes a middle lid portion which, from a transverse upper edge of a short narrow side of the container, is upwardly inclined toward an opposite narrow side thereof. The lid portion, at a distance from the upper edge, has a projecting tongue forming a breakable seal adapted to be fixed to a planar top side portion of the container. A locking tongue, upon a reclosing of the pouring spout, is adapted to be inserted under a transverse free end edge portion of the top side portion.

10 Claims, 2 Drawing Sheets

PACKAGING CARTON FOR DRY, FLOWABLE PRODUCTS

This application is a continuation of application Ser. No. 07/476,465, filed Jun. 8, 1990 now abandoned.

FIELD OF THE INVENTION

The present invention relates to a packaging container and, more particularly, to a container for dry, tricklable products, with the container being produced by folding and fixing of a flat part member, both sides of which are coated with an artificial resin or plastic layer, and with the cart member being prepunched and provided with folding lines and a top end portion with a reclosable opening fashioned as an unfoldable pouring spout.

BACKGROUND OF THE INVENTION

In, for example, DE-B1 12 79 533, DE-A1 34 02 096, and U.S. Pat. No. 1,697,644, 2,064,029 and 3,185,374, packaging containers of the aforementioned type are proposed. However, a common problem for these proposed packaging containers resides in the fact that they use glue on the top and bottom surfaces for closing or fixing the container. In order to obtain safe glue joints relatively large overlapping areas are required and, consequently, the top and bottom surfaces of these proposed packaging containers have double walls. Additionally, the opening of the containers and the unfolding of the pouring spout is dependent upon the packaging blanks being provided with perforations along which the carton material has to be broken. Such perforations adversely affect the possible barrier effect of the packaging material, and the punching of the packaging blanks is also considerably complicated because stops are quite often required for controlling the perforations.

SUMMARY OF THE INVENTION

The aim underlying the present invention essentially resides in providing a packaging container of the aforementioned type which avoids the above mentioned disadvantages encountered in the prior art in a simple manner.

According to the invention, the packaging container is characterized in that the pouring spout comprises a middle lid portion which, from a transverse upper edge of a short narrow side of the container, stretches inwardly towards an opposite longer narrow side thereof, with a lid portion opposite to the transverse edge having a projecting tongue adapted to form a breakable seal for the pouring spout in a closed condition and adapted to form holding means for the pouring spout upon reclosing thereof. The pouring spout on each side of the lid portion has side wings connected with opposite broad sides of the container, with the side wings being adapted, by closing of the pouring spout, to be folded under the lid portion which stretches inclined in respect to the remaining plane top side portion formed of a foldable end wing and therewith connected to top side wings adapted to be mutually combined along the middle of the plane top side portion.

By virtue of the above noted features of the present invention, a packaging container is obtained, which, in a simple manner, avoids the disadvantages of known packaging containers since the opening of the package and the unfolding of the pouring spout may be carried out without providing any tearing perforations. In practical use, the presence of tearing perforations may, in addition to affecting the tightness of the package, often result in directly adversely affecting the reclosing function of the package since the breaking of the perforations results in the risk of unintended torn top side portions of the container. During production, a very considerable simplification is realized since, without tearing perforations formed by punching, the carton blanks no longer have to be inspected for damage resulting from the punching operation.

As noted above, the packaging container according to the present invention is constructed so as to permit mutual fixing of the respective wing portions by ultrasound or supersonic welding which, during closing and sealing of the packaging container, only requires a small overlap of carton material. This results in an appreciable saving of carton material of about 12–20% for a typical packaging container with a capacity of, for example, 1.5–2.0 liters. Also, effective reclosing of the container may take place in a simple manner without requiring special instruction.

In accordance with further features of the present invention, the reclosable pouring spout is constructed such that the lid portion is inclined between a short narrow side of the container and the remaining plane top side portion thereof. In particular, the pouring spout appropriately may be designed and placed so that the lid portion of the pouring spout, in an open position, extends approximately as a continuation of the short narrow side since the side wings of the pouring spout have the shape of an isosceles triangle with top angles in level with the transverse edge forming a hinge for the lid portion of the pouring spout.

In order to obtain a more accurate pouring of the contents of tricklable material from the container, in accordance with further features of the present invention, the lid portion of the pouring spout is preferably shaped such that it may be folded to form a concave spout bottom at the inner side thereof by folding lines which, from each side of the transverse hinge edge, are inclined upwardly to a middle of a transverse folding line between the lid portion and the projecting tongue which is also provided with a central folding line in level with the middle of the lid portion so that the tongue may also be "broken".

Advantageously, in accordance with the present invention, the tongue projecting from the lid portion may be shaped such that the tongue, by insertion under a free edge portion of the plane top side portion, may be locked, with the locking being obtained by, for example, notches at opposite sides of the locking tongue in front of the folding line between the lid portion and the locking tongue. Opposite corner areas between the plane top side portion and the side wings of a pouring spout may engage the notches in the locking tongue when inserted under the free front edge of the top side portion.

To simplify the production of the packaging container, opposite sides of the carton blank may be coated with a layer of artificial resin (plastic) so that mutual fixing of the respective side and/or end portions of the carton or card-board blank may be effected by heat sealing, preferably, ultrasound (supersonic) welding.

In comparison to known packaging containers of a similar type, it is a considerable advantage of the packaging container according to the invention in that fixing or sealing, after a folding, may be achieved by welding the plastic or artificial resin coating of the carton blank in a controlled manner.

BRIEF DESCRIPTION OF THE DRAWINGS

The invention is described in more detail in the following description when taken in connection with the accompanying drawings, wherein.

DETAILED DESCRIPTION

Figure 1:
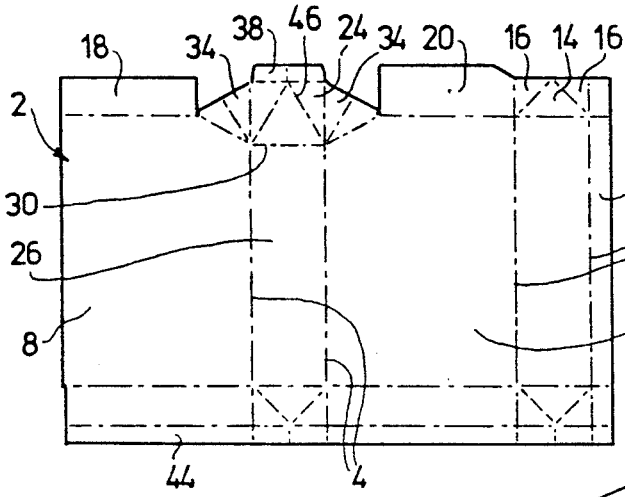
FIG. 1 is a plane view of an embodiment of a carton blank for a packaging container according to the invention, as viewed from an external or outer side thereof.
Figure 2:
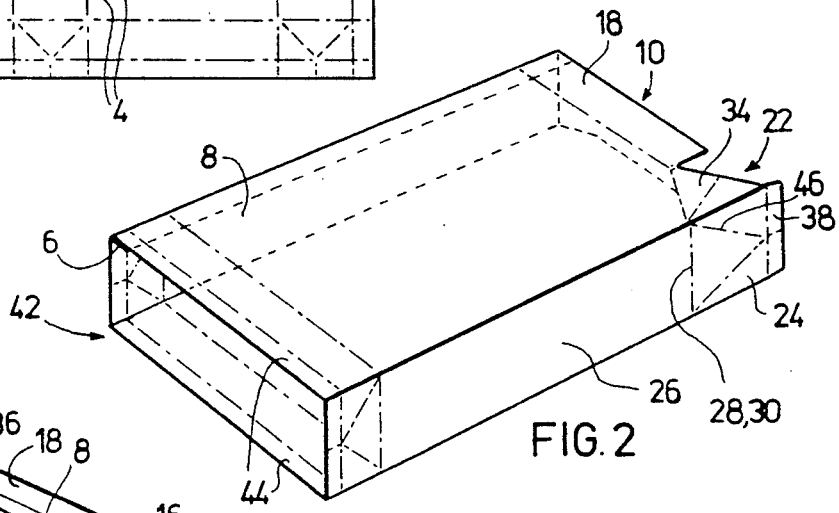
FIG. 2 is a perspective view of a partially folded container blank according to the invention.

Referring now to the drawings wherein like reference numerals are used throughout the various views to designate like parts and, more particularly, to FIG. 1, according to this figure, a carton blank or cardboard blank 2 is provided with folding lines 4, with the folding lines 4 dividing the carton blank into fields corresponding to respective side portions of a packaging container, with the individual fields being designated by the same reference numerals are the respective side portions described more fully hereinbelow. The carton blank 2 is provided, at both sides thereof, with a coating of an artificial resin or plastic. The coating consists of polyethylene or of a similar heat-sealable artificial resin so as to enable a fixing of the folded container blank by ultrasound welding on suitable mandrels. At first the carrier blank 2 is folded, as shown most clearly in FIG. 2 to a four-sided tube by folding along the folding lines 4 between the respective narrow and broad sides of the container. Subsequently, a longitudinally extending welding joint is made for fixing a narrow connection portion 6 to a side edge portion of a broadside 8.

Figure 3:
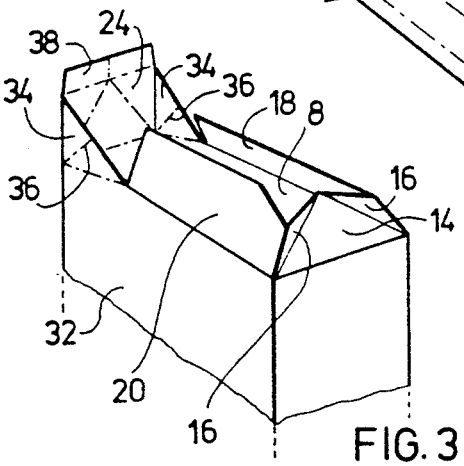
FIG. 3 is a perspective partial view of an upper end portion of a packaging container according to the invention illustrating a closing thereof.
Figure 4:
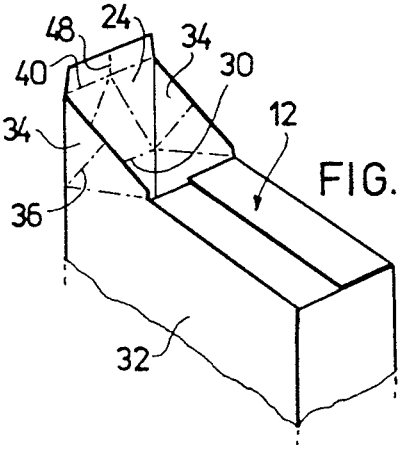
FIG. 4 is a perspective view similar to FIG. 3, but with the plane top side portion of the container closed.
Figure 5:
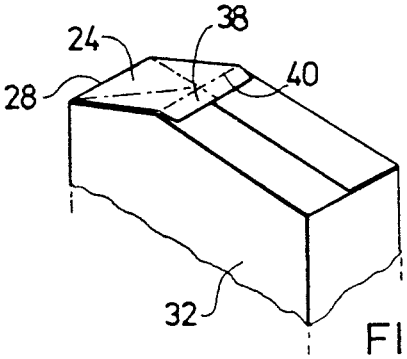
FIG. 5 is a perspective partial view of a closed upper end portion of a container according to the invention.

Afterwards, an upper end portion 10 of the container is closed in a manner shown in FIGS. 3–5. Since a plane topside portion 12 is first closed by folding a three-sided end wing 14, the three-sided smaller side wings 16 respectively located between the end wing and a narrow top side wing 18 and a broader top side wing 20 are, at the same time, folded under the narrow top side wings 18 and broader top side varying 20. The broader top side wing 20 at the corner portion of one of the three-sided smaller side wings 16 has an inclined cutting so that the broad top side wing 20 is allowed to be inserted under the narrow top side wing 18 since the inclined cutting makes the insertion possible without interference by the opposite three-sided end wing 14 already folded under the narrow top side wing 18. Afterwards, the plane top side portion 12 is fixed by ultrasound welding on a suitable mandrel.

The remaining portion of the upper end portion 10 including of a pouring spout 22, having a middle lid portion 24, is connected with a narrow side 26 along a transverse edge 28 at the top of the narrow side 26. The edge 28 is represented by a folding line 30 between the lid portion 24 and the narrow side 26. The lid portion 24 is, at both sides thereof, connected with the broad side 8 and an opposite broadside 32, respectively, by foldable three-sided side wings 34. The wings 34 are shaped as isosceles triangles being mounted with top angles being level with the transverse edge 28 forming a hinge between the lid portion 24 and the narrow side 26.

Figure 6:
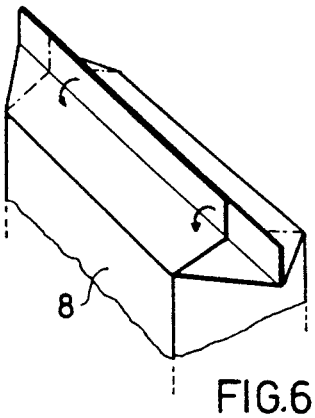
FIGS. 6–8 are perspective views illustrating the bottom closing of the packaging container according to the invention.
Figure 7:
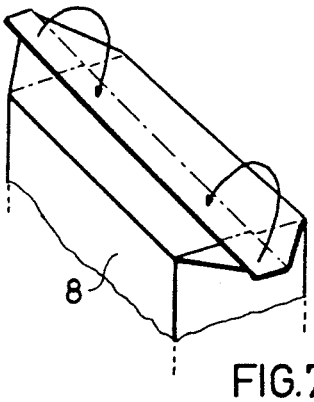
Figure 8:
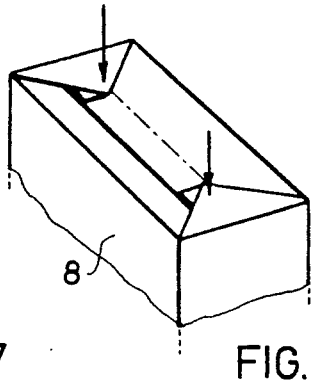
Figure 9:
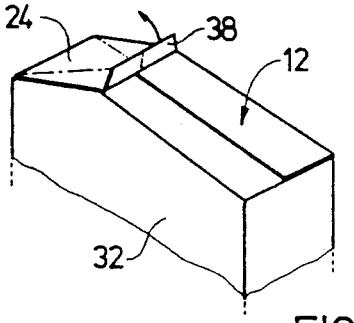
FIG. 9 is a perspective partial view illustrating a tearing of the packaging container according to the invention.
Figure 10:
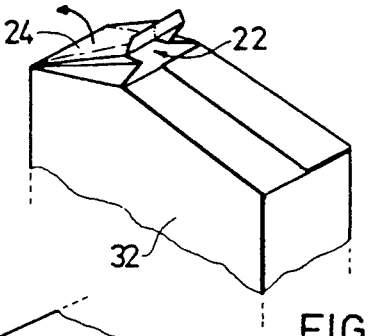
FIG. 10 is a similar partial view illustrating an opening of the pouring spout of the packaging container according to the invention.

The folding of the side wings 34 is effected along folding lines 36 along the angle bisectors of the top angles to an opposite free edge portion of the side wings 34 which, in this manner, by the folding of the lid portion 24, may be folded under the lid portion 24 (FIG. 10). Opposite to the folding line 30, the lid portion 24 is provided with a projecting tongue 38 which, as shown in FIG. 5, may serve as a breakable seal, because the tongue 38 projects over a transverse end edge portion of the top plane side portion 12. The tongue 38 may be fixed to the top side portion 12 by ultrasound welding along a transverse line placed near a folding line 40 between the lid portion 24 and the tongue 38 so as to enable an easy gripping of the outermost edge portion of the tongue 38 for breaking the transverse welding seam upon an opening of the pouring spout 22, (FIG. 9). The closing of the upper end portion 10 is effected by an ultrasound welding along opposite side edges of the lid portion 24 so that the lid portion 24, in a breakable manner, is welded together with the folded side wings 34. When the upper end portion 10 is closed and fixed, the filling of the packaging container may take place from an open bottom end 42 after the filling of the packaging container, the bottom end 42 is closed in a known manner as shown in FIGS. 6–8, with lower edge portions 44 being welded together as shown in FIG. 6. Subsequently, the edge portions 44 are folded against the bottom surface before the narrow side projecting end portions of the container are folded inwardly and pressed upwardly and fixed for forming a substantially concave bottom surface.

As shown in FIGS. 9 and 10, to open the sealed packaging container, the tongue is first bent upwardly so as to enable the same to be easily gripped. The transverse welding seam is easily broken by pulling the tongue 38 upwardly. By simultaneously inwardly squeezing opposite broad sides 8, 32 just under the inclined pouring spout 22 it is possible to facilitate a breaking of the welding seams along opposite side edges of the lid portion 24 (FIG. 10). Thereafter, the pouring spout 22 may be fully opened or unfolded and, as shown in FIG. 11, may be used to pour the contents out of the packaging container.

Figure 11:
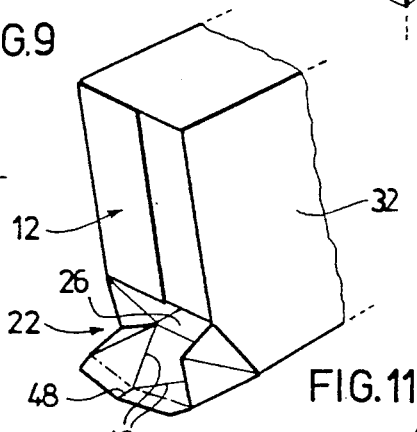
FIG. 11 is a perspective partial view of a packaging container according to the invention in a typical situation of use.

As shown in FIG. 11, the lid portion 24 of the pouring spout 22, by virtue of the folding lines 46 and a middle bend line 48, has a concave spout bottom which makes it more easy to control the pouring of the contents out of the packaging container. The pouring spout 22 may be reclosed by swinging the lid portion 24 inwardly. The pouring spout may, in a simple and almost tight manner, be reclosed and fixed by insertion of the tongue 38 under the free transverse end edge of the plane top side portion 12, (FIG. 12).

Figure 12:
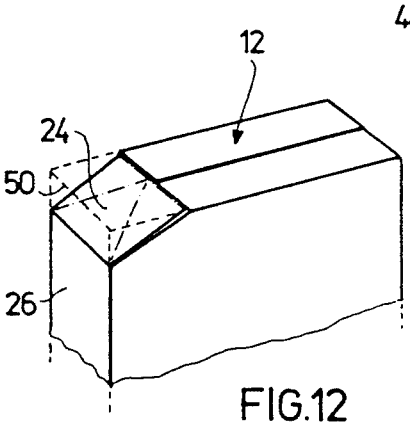
FIG. 12 is a further perspective view of an appropriate placement of the pouring spout in an inclined position at one side of the upper end of the packaging container according to the invention.

As shown in phantom line in FIG. 12, the packaging container according to the invention may also be provided with a substantially planar topside, with the pouring spout being hinged about a narrow top side edge 50.

Figure 13:
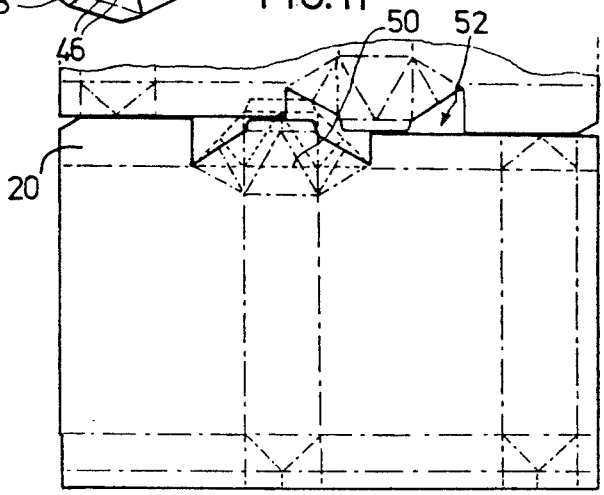
FIG. 13 is a plane view of a carton blank for producing a packaging container according to the invention.

The carton blank 52 may, as shown in FIG. 13, may have a broad top side wing placed in an opposite relationship with respect to the carton blank 2. By virtue of such an arrangement, it is possible to save carton material since the broad top side wing 20 is placed in the same portion of the carton blank 52 where the pouring spout is located, that is, the carton blanks 52, during the punching out thereof may be neutrally displaced in a reverse position so as to result in a minimum of waste carton material by using an initial material having a width corresponding to the height of two carton members 52.

Additionally, FIG. 13, in phantom lines, illustrates the manner by which a planar pouring spout makes the carton blank 52 larger. This arrangement emphasizes some advantages obtained by the inclined pouring spout 22 which, in the first place enables a saving of material and, in the second place, provides a larger and better marked pouring spout 22. In particular, the last mentioned advantage by the inventión is considered as important because, from the point of view of the consumers, it is desirable to have a clearly marked and large pouring spout.

Figure 14:
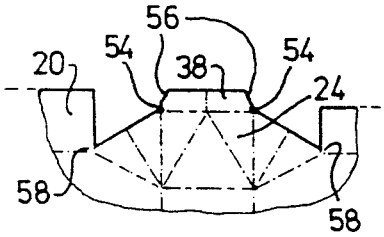
FIG. 14 is an enlarged partial view of a locking tongue of the pouring spout of the packaging container according to the invention.

As shown in FIG. 14, the locking tongue 38, at the base thereof, in level with the folding line between the locking tongue 38 and the lid portion 24, is provided with concave notches 54 inside inclined side edges 56 of the locking tongue 38. The notches 54 are adapted to cooperate with opposite corner areas 58 at the free transverse end edge of the plane top side portion 12. The width of the free transverse edge is, for example, smaller than the width of the pouring spout 22 and the locking tongue 38.

The packaging container according to the invention, irrespective of being provided with a partially inclined top side portion or with a substantially planar top side portion, makes it possible to obtain a compact filling of the package so that, on top of the filled product, whether a dry, tricklable, paste-like or liquid product, there will be no air space which may adversely influence the durability of possible products having limited durability.

I claim:

1. A rectangular packaging container for dry, tricklable products produced by folding and welding of a flat carton member provided with folding liens, the container comprising pouring spout means for reclosably sealing an opening of the container, said pouring spout means being disposed at a narrow side of the container wherein said pouring spout means comprises a middle lid portion extending inwardly from a transverse upper edge of a short narrow side of the container towards the opposite longer narrow side of the container, a projecting tongue provided on said middle lid portion at a position opposite to said transverse upper edge, said projecting tongue being welded to a remaining planar top side portion of the container to form a breakable seal for the pouring spout means in a closed position of the pouring spout means, said pouring spout means upon breakage of said breakable seal being unfoldable from said closed position to an open position to permit pouring of a dry, tricklable produce from the container through said opening via said pouring spout means, after breakage of said breakable seal said projecting tongue forming a holding means for the pouring spout means for reclosing said opening, said pouring spout means further including first side wings provided at each side of the middle lid portion, said first side wings being connected at one side thereof with opposite broad sides of the container and being connected at a second side thereof with said middle lid portion and having a third side in the form of a free edge extending from said first side to said second side of said first side wing and in said closed position of the pouring spout means said side wings being folded under the middle lid portion and when said pouring spout means is in the open position said first side wings being unfolded, and wherein said remaining planar top side portion of the container is formed with an end wing connected with a transverse upper edge of said opposite longer narrow side and extending inwardly therefrom towards said short narrow side of the container, and a pair of top side wings connected with respective ones of upper edges of said opposite broad sides of the container and extending inwardly toward each other so as to overlap with each other at their outer edges with a transverse free end edge of the planar top side portion being formed by free ends of the top side wings at one end thereof, a pair of smaller, second side wings being connected to said end wing and to respective ones of said top side wings at a second end therefore opposite said one end and said second side wings being folded in under said top side wings and over said end wing, said top side wings being welded to each other along a middle of said planar top side portion where said top side wings overlap one another.

2. A packaging container according to claim 1, wherein said pair of top side wings includes a broader top side wing and a narrower top side wing whose outer edge overlies the outer edge of said broader top side wing and is welded thereto, the outer edge of said broader top side wing adjacent the smaller, second side wing connected thereto being inclined with respect to an extending direction of the broader top side wing from its broad side of the container for allowing the insertion of the broader top side wing under the narrower top side wing during folding of the container.

3. A packaging container according to claim 2, wherein said end wing is three-sided and wherein said pair of smaller, second side wings are each three-sided.

4. A packaging container according to claim 1, wherein a layer of an artificial resin or plastic is provided on both sides of the carton member, and wherein respective sides and/or end portions of the carton member are welded by heat sealing.

5. A packaging container according to claim 1, wherein in said open position of said pouring spout means, the middle lid portion substantially forms a continuation of said narrow side and wherein said first side wings are shaped as isosceles triangles having top angles disposed level with said transverse edge so as to form a hinge for the middle lid portion of the pouring spout means.

6. A packaging container according to claim 5, wherein folding lines extend from each side of a transverse edge of the hinge and are inclined upwardly toward a middle of a transverse folding line between the middle lid portion and said projecting tongue so as to enable the middle lid portion to form a concave bottom for the pouring spout means, and wherein said projecting tongue is provided with a central folding line at a middle of the middle lid portion.

7. A packaging container according to claim 1, wherein prior to a filling of the container, the pouring spout means and the planar top side portion are folded and fixed by welding seams along opposite sides of the middle lid portion and along said transverse free end edge of the planar top side portion, along a middle of the planar top side portion and by a transverse welding seam along a narrow side edge of the planar top side portion opposite to said pouring spout means.

8. A packaging container according to claim 7, wherein the transverse welding seam along the free end edge of the planar top side portion is spaced at a distance from a free edge of the projecting tongue, and wherein the welding seams along opposite sides of the middle lid portion are breakable by pulling the free edge of the tongue.

9. A packaging container according to claim 1, wherein the container is welded by ultrasonic or supersonic welding.

10. A packaging container according to claim 1, wherein the container includes welding seams along opposite sides of the middle lid portion which are breakable by applying an inward pressure on opposite broad sides of the top end portion of the container at a position just under the pouring spout means.

* * * * *